US010744399B2

(12) United States Patent
Sifuentes, III

(10) Patent No.: US 10,744,399 B2
(45) Date of Patent: Aug. 18, 2020

(54) THREE-DIMENSIONAL CHESS SET, GAMEBOARD AND STORAGE TRAY

(71) Applicant: Jose Sifuentes, III, Chula Vista, CA (US)

(72) Inventor: Jose Sifuentes, III, Chula Vista, CA (US)

( * ) Notice: Subject to any disclaimer, the term of this patent is extended or adjusted under 35 U.S.C. 154(b) by 0 days.

(21) Appl. No.: 15/681,374

(22) Filed: Aug. 19, 2017

(65) Prior Publication Data

US 2020/0038740 A1 Feb. 6, 2020

(51) Int. Cl.
*A63F 3/00* (2006.01)
*A63F 3/02* (2006.01)

(52) U.S. Cl.
CPC ..... *A63F 3/00214* (2013.01); *A63F 3/00261* (2013.01); *A63F 3/00643* (2013.01); *A63F 3/00895* (2013.01); *A63F 3/02* (2013.01); *A63F 2003/00403* (2013.01); *A63F 2003/00646* (2013.01); *A63F 2003/00943* (2013.01)

(58) Field of Classification Search
CPC .... A63F 3/00214; A63F 3/02; A63F 3/00261; A63F 3/00643; A63F 3/00895; A63F 2003/00646; A63F 2003/00403; A63F 2003/00943
USPC ..... 273/241, 280, 260, 261, 262, 287, 309
See application file for complete search history.

(56) References Cited

U.S. PATENT DOCUMENTS 4,179,127 A * 12/1979 Goodman ..... A63F 3/00214 273/241
4,391,447 A * 7/1983 Dudley ..... G09B 19/22 273/238
4,534,565 A * 8/1985 Hube ..... A63F 3/00214 273/241
4,696,476 A * 9/1987 Eplett ..... A63F 3/00214 273/241
5,280,913 A * 1/1994 Sirk ..... A63F 3/0023 206/311
5,338,041 A * 8/1994 Jones ..... A63F 3/02 273/259
5,848,788 A * 12/1998 Hess ..... A63F 3/00643 273/239
6,273,422 B1 * 8/2001 McGahan ..... A63F 3/00214 273/241
2002/0125636 A1 * 9/2002 Lundberg ..... A63F 3/00094 273/241
2010/0148440 A1 * 6/2010 Hart ..... A63F 3/00094 273/241
2016/0059115 A1 * 3/2016 Camaratta, Jr. ..... A63F 3/00697 53/452
2017/0087454 A1 * 3/2017 Reichmuth ..... A63F 3/00214

FOREIGN PATENT DOCUMENTS

RU 2097086 C1 * 11/1997

* cited by examiner

*Primary Examiner* — Vishu K Mendiratta
(74) *Attorney, Agent, or Firm* — The Iwashko Law Firm, PLLC; Lev Ivan Gabriel Iwashko

(57) ABSTRACT

A three-dimensional chess set includes a three-dimensional chess gameboard having a multi-tiered playing surface, and a three-dimensional tray for storing chess playing pieces within the three-dimensional chess gameboard.

4 Claims, 1 Drawing Sheet

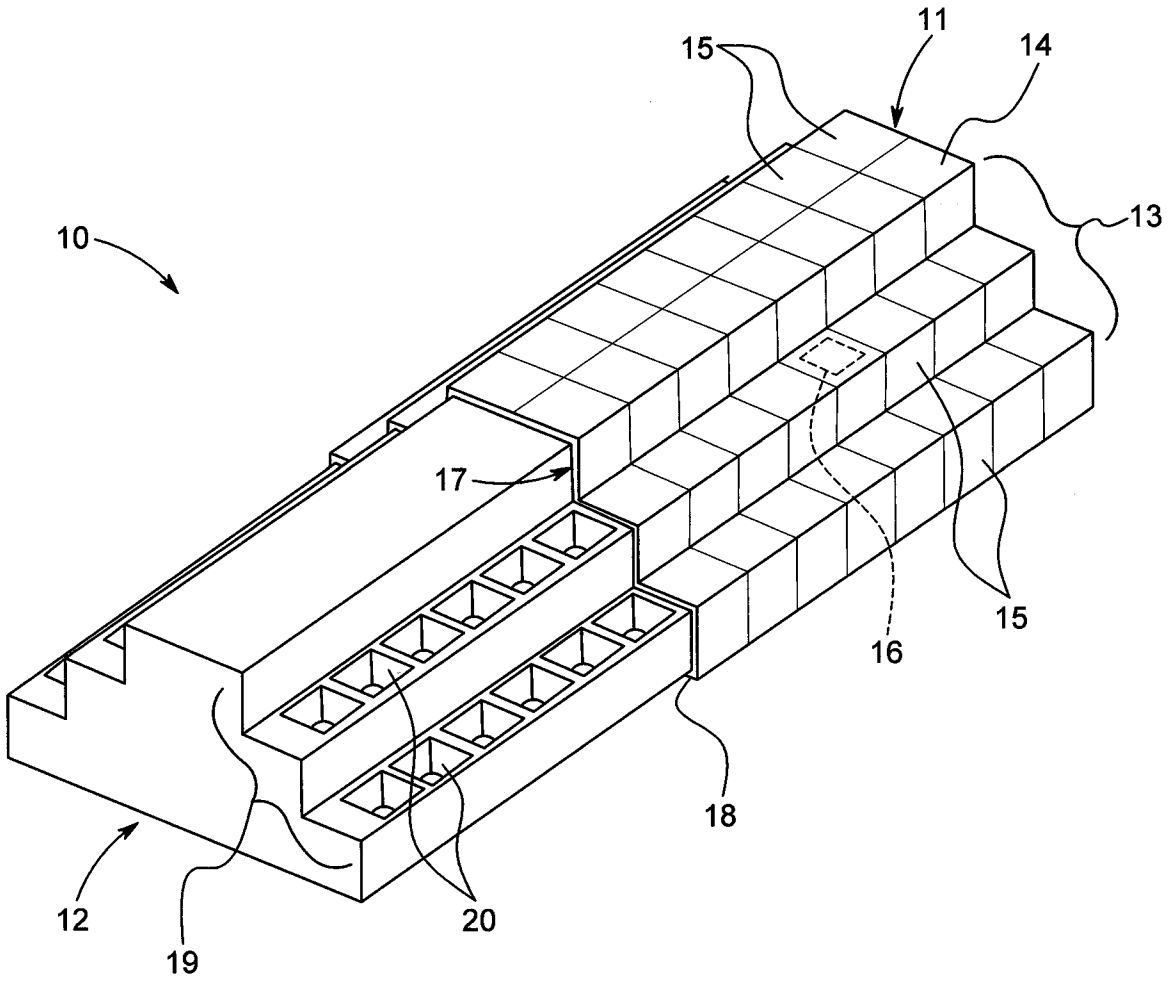
10
11
12
13
14
15
15
16
17
18
19
20

THREE-DIMENSIONAL CHESS SET, GAMEBOARD AND STORAGE TRAY

BACKGROUND OF THE INVENTION

1. Field of the Invention

The present general inventive concept relates generally to the game of chess and, more particularly, to a three-dimensional chess set, chess gameboard and chess playing pieces storage tray.

2. Description of the Related Art

Chess is traditionally played using two sets of 16 playing pieces, with each set in a different color (such as light and dark) from the other, for each of two players on a flat two-dimensional square checkered game board with 64 squares arranged in an 8×8 grid. The set of 16 playing pieces for each player includes: one king, one queen, two rooks, two knights, two bishops, and eight pawns. The pieces for each player are placed at predetermined positions on the two rows of squares along two opposing sides of the game board, leaving four rows of empty squares between them, at the start of a game.

Alternative two-dimensional designs of the standard checkered gameboard have been proposed from time to time to instill fresh enthusiasm for the game of chess. However, such alternative designs have failed to gain traction and so there still remains a need for a different approach to instill fresh enthusiasm for the game of chess.

Therefore, there is still a need for an alternative chess gameboard design having features that will overcome the shortcomings of the alternative approaches of prior art two-dimensional designs that failed to instill fresh enthusiasm for the game of chess.

SUMMARY

The present general inventive concept provides a three-dimensional chess set, a three-dimensional gameboard and a three-dimensional storage tray that provide a different entertaining option to traditional chessboards so as to instill fresh enthusiasm for the game of chess.

Additional features and utilities of the present general inventive concept will be set forth in part in the description which follows and, in part, will be obvious from the description, or may be learned by practice of the general inventive concept.

The foregoing and/or other features and utilities of the present general inventive concept may be achieved by providing a three-dimensional chess set, including a three-dimensional chess gameboard, and a three-dimensional tray for storing chess playing pieces within the three-dimensional chess gameboard.

The three-dimensional chess gameboard may include a multi-tiered structure having a chess playing surface thereon containing multiple squares having electronic portions that are activated by chess playing pieces also having electronic portions that illuminate the squares when placed thereon.

The three-dimensional chess gameboard may include an interior chamber being open at least at one end for slidably receiving and removing a three-dimensional storage tray for holding the chess playing pieces.

The three-dimensional storage tray may include a multi-tiered structure having two tiered rows of multiple pockets along each of a pair of opposite sides of the multi-tiered structure for holding the chess playing pieces.

BRIEF DESCRIPTION OF THE DRAWINGS

These and/or other features and utilities of the present generally inventive concept will become apparent and more readily appreciated from the following description of the embodiments, taken in conjunction with the accompanying drawings of which:

FIG. 1 is a front perspective view of a three-dimensional chess set built in accordance with the present general inventive concept.

DETAILED DESCRIPTION OF THE INVENTION

Various example embodiments (a.k.a., exemplary embodiments) will now be described more fully with reference to the accompanying drawings in which some example embodiments are illustrated. In the FIGURES, the thicknesses of lines, layers and/or regions may be exaggerated for clarity.

Accordingly, while example embodiments are capable of various modifications and alternative forms, embodiments thereof are shown by way of example in the figures and will herein be described in detail. It should be understood, however, that there is no intent to limit example embodiments to the particular forms disclosed, but on the contrary, example embodiments are to cover all modifications, equivalents, and alternatives falling within the scope of the disclosure. Like numbers refer to like/similar elements throughout the detailed description.

It is understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between." "adjacent" versus "directly adjacent," etc.).

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements and/or components, but do not preclude the presence or addition of one or more other features, integers, steps, operations, elements, components and/or groups thereof.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art. However, should the present disclosure give a specific meaning to a term deviating from a meaning commonly understood by one of ordinary skill, this meaning is to be taken into account in the specific context this definition is given herein.

Referring now to FIG. 1 of the drawings, a three-dimensional chess set 10, according to an exemplary embodiment of the present general inventive concept, is illustrated. The three-dimensional chess set 10 include a three-dimensional chess gameboard 11, and a three-dimensional tray 12 for storing chess playing pieces (not shown) within the three-dimensional chess gameboard 11.

The three-dimensional chess gameboard 11 may include a three-dimensional multi-tiered structure 13 that has a chess playing surface 14 thereon. The chess playing surface 14 contains an arrangement of multiple squares 15 that may have electronic portions 16 (only illustrated with a representative one of the squares) thereon that are connected to a conventional computer system (not illustrated) and activated by chess playing pieces which also may have electronic portions, causing illumination of the squares when placed thereon.

The three-dimensional multi-tiered structure 13 of the three-dimensional chess gameboard 11 may also include an interior chamber 17 that is open at least at one end 18. The three-dimensional tray 12 has a three-dimensional multi-tiered structure 19 that is complementary in its three-dimensional shape to that of the three-dimensional multi-tiered structure 13 of the three-dimensional chess gameboard 11. Thus, the three-dimensional tray 12 is slidably receivable in and removable from the three-dimensional chess gameboard 11.

The three-dimensional multi-tiered structure 19 of the three-dimensional tray 12 may also have two tiered rows of multiple pockets 20 along each of a pair of opposite sides of the multi-tiered structure for holding the chess playing pieces.

From the foregoing description, it may be readily understood that the three-dimensional chess gameboard embodies two functions. The first function is to provide a three-dimensional multi-tiered chess playing surface with multiple squares that have electronic portions which are illuminated by contact with chess playing pieces also having electronic portions thereon that activate the electrical portions of the multiple squares. The second function is to provide a three-dimensional storage cover for the three-dimensional storage tray that provides the multi-tiered pockets for holding chess playing pieces. The three-dimensional storage tray is storable within and removable from the three-dimensional storage cover form of the three-dimensional chess gameboard.

The three-dimensional feature of the structures of the gameboard 11 and storage tray 11 refers to their having the aspects of length, width and height. The gameboard 11 may also include a computerized memory system that records moves from both players in order to allow post-game revision of tactics used, empowering the players to improve their skills by learning from mistakes and/or accomplishments made during each game.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A three-dimensional chess set, comprising:

a three-dimensional chess gameboard having a multi-tiered playing surface, the three-dimensional chess gameboard comprising;

a three-dimensional multi-tiered structure, a chess playing surface thereon containing multiple chess playing squares in a three-dimensional multi-tiered arrangement, and an interior chamber defined by said three-dimensional multi-tiered structure being open at least at one end; and a three-dimensional tray slidably receivable within and removable from the interior chamber for storing chess playing pieces within the three-dimensional chess gameboard, the three-dimensional tray comprising:

a first tier disposed at a base of the three-dimensional tray to store a first set of the chess playing pieces therein, and a second tier disposed at a height different with respect to a height of the first tier to store a second set of the chess playing pieces therein.

2. The three-dimensional chess set of claim 1 wherein the chess playing surface having electronic portions disposed within the multiple chess playing squares and configured to activate by the chess playing pieces with complementary electronic portions configured to illuminate the multiple chess playing squares in response to the chess playing pieces being disposed thereon.

3. The three-dimensional chess set of claim 1 wherein said three-dimensional tray further comprises:

a three-dimensional multi-tiered structure; and an arrangement of multiple pockets in two tiered rows along each of a pair of opposite sides of the three-dimensional multi-tiered structure for holding the chess playing pieces.

4. A three-dimensional chess gameboard, comprising:

a three-dimensional multi-tiered structure;

a chess playing surface on said three-dimensional multi-tiered structure containing multiple chess playing squares in a three-dimensional multi-tiered arrangement; and an interior chamber defined by said three-dimensional multi-tiered structure being open at least at one end for slidably receiving and removing a three-dimensional storage tray for holding the chess playing pieces, the interior chamber comprising:

a first tier disposed at a base of the interior chamber to receive a first tier of the three-dimensional storage tray therein, and a second tier disposed at a height different with respect to a height of the first tier to receive a second tier of the three-dimensional storage tray therein.

* * * * *